United States Patent [19]

Brown et al.

[11] Patent Number: 4,838,826

[45] Date of Patent: Jun. 13, 1989

[54] TOY TELEPHONES AND CORDS FOR TOY TELEPHONES

[75] Inventors: Robert J. Brown; Roberta Brown, both of Bonne Terre; Carl Rhodes, St. Louis, all of Mo.

[73] Assignee: Handi-Craft Company, St. Louis, Mo.

[21] Appl. No.: 240,510

[22] Filed: Sep. 6, 1988

[51] Int. Cl.[4] ..... A63H 33/30

[52] U.S. Cl. ..... 446/141; 446/490

[58] Field of Search ..... 446/141, 142, 227, 121, 446/490; 379/435; 181/18–22

[56] References Cited

U.S. PATENT DOCUMENTS

| | | | |
|---|---|---|---|
| 1,037,532 | 9/1912 | Redlich | 446/141 X |
| 3,693,748 | 9/1972 | Jones et al. | 181/20 |
| 3,769,744 | 11/1973 | Sloane, Jr. et al. | 446/142 |

*Primary Examiner*—Mickey Yu

*Attorney, Agent, or Firm*—Senniger, Powers, Leavitt and Roedel

[57] ABSTRACT

A toy telephone having a telephone base, a telephone handset, and a cord extending between the base and the handset, the cord having first and second cord segments of preselected lengths, the first cord segment connected at one end to the base and the second cord segment connected at one end to the handset. Mating connectors at the free ends of the first and second cord segments releasably connect the cord segments to form a single continuous cord between the base and the handset that has an apparent length that is longer than the length of either cord segment and sufficiently long for play use. Upon application of a force in excess of that normally encountered in play use, the connectors allow the cord to separate into its component segments.

21 Claims, 1 Drawing Sheet

FIG. 1
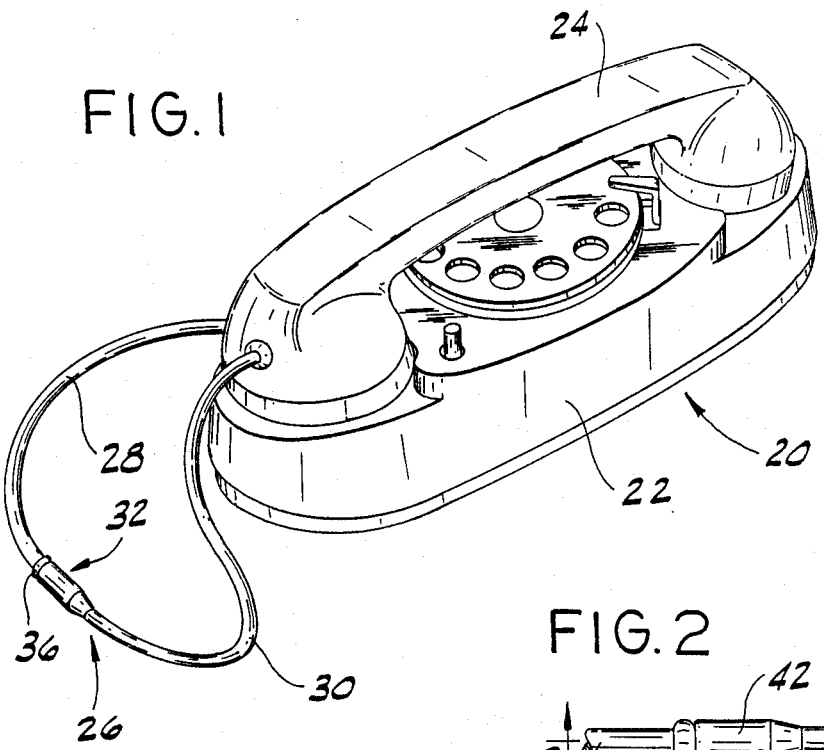
FIG. 2
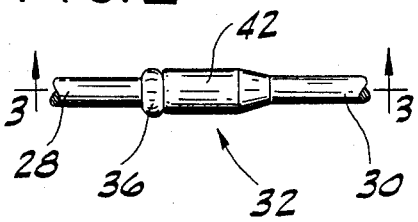
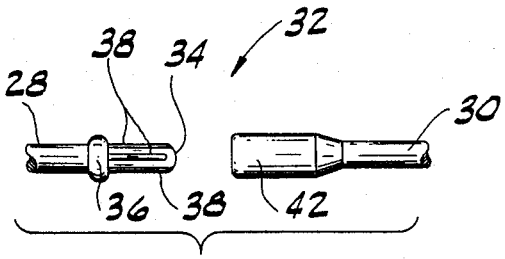
FIG. 5
FIG. 3
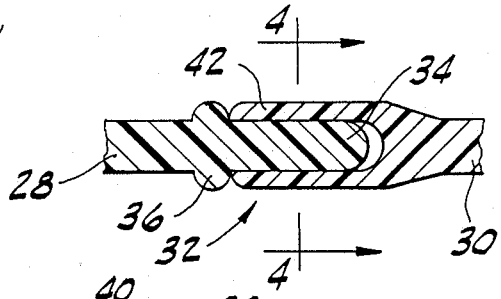
FIG. 6
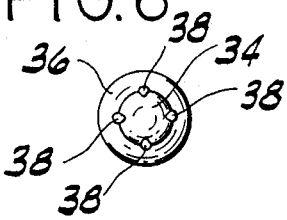
FIG. 4
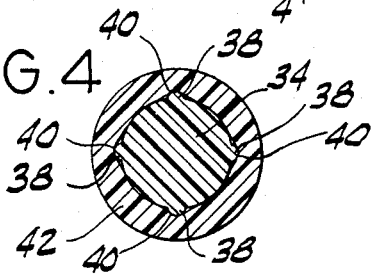

TOY TELEPHONES AND CORDS FOR TOY TELEPHONES

BACKGROUND OF THE INVENTION

This invention relates to toy telephones and in particular to cords for toy telephones.

Toy telephones usually have a cord connecting the telephone base and the telephone handset in order to realistically simulate a real telephone. However, it has recently come to light that long cords can pose certain risks, for example entangling the user. For this reason, voluntary guidelines have been adopted by toy manufacturers limiting the length of cords in toy telephones and similar toys. However, the shortened cords are not long enough to allow a child to use the toy telephone in a conventional manner. Thus, the shortened cord detracts from the realism of the toy, and makes the toy less fun to play with.

SUMMARY OF THE INVENTION

It is among the objects of the present invention to provide a toy telephone with a cord which under normal conditions is sufficiently long to allow normal play use of the toy telephone, but which under abnormal conditions separates into shorter segments to reduce the risks associated with longer cords. Thus it is an object of the invention to provide a toy telephone in which the cord comprises at least two segments which are joined together sufficiently to resist separation under forces encountered during normal play use of the toy telephone but which readily separate under forces in excess of those encountered during normal play, such as if the cord entangles the user.

In general, the toy telephone of the present invention comprises a telephone base and a telephone handset and a cord extending between the base and the handset. The cord comprises first and second cord segments of preselected lengths. The first cord segment is connected at one end to the telephone base and the second cord segment is connected at one end to the telephone handset. The cord further comprises means for releasably connecting the free ends of the first and second cord segments together to form a single continuous cord between the base and the handset that is longer than either cord segment, and sufficiently long to allow the toy telephone to be used like a real telephone. The releasable connecting means is such that upon application of a force in excess of that normally encountered in play use of the telephone, the cord readily separates into the segments of pre-selected lengths.

Thus, the toy telephone of the present invention has a cord that has an apparent length sufficient to allow realistic play use of the toy telephone. The cord maintains its apparent length during normal play use of the toy telephone, but readily separates into its shorter components upon the application of forces in excess of those encountered in normal play use of the toy telephone, thereby reducing the risks associated with long cords. Furthermore, the toy telephone of the present invention is less likely to be damaged from abuse, because the cord readily separates so it is less likely that the cord will be detached from the base or the handset.

These and other objects will be in part apparent and in part pointed out hereinafter.

BRIEF DESCRIPTION OF THE DRAWINGS

FIG. 1 is a perspective view of a toy telephone with a cord constructed according to the principles of this invention;

FIG. 2 is a enlarged partial view of the cord, showing the connector for joining the segments of the cord;

FIG. 3 is a partial longitudinal cross sectional view of the cord taken along the plane of line 3—3 in FIG. 2, through the connector;

FIG. 4 is an enlarged transverse cross sectional view of the cord taken along the plane of line 4—4 in FIG. 3, through the connector;

FIG. 5 is a partial exploded view of the cord, showing the cord segments separated; and FIG. 6 is an end view of the stud half of the connector.

Corresponding reference numerals indicate corresponding parts throughout the several views of the drawings.

DETAILED DESCRIPTION OF THE PREFERRED EMBODIMENT

A toy telephone constructed according to the principles of this invention, indicated generally as 20, is shown in FIG. 1 as comprising a telephone base 22, a telephone handset 24, and a cord 26 extending between the base and the handset.

The cord 26 comprises a first cord segment 28, connected at one end to the telephone base 22, and a second cord segment 30, connected at one end to the telephone handset 24. The cord 26 further comprises means for releasably connecting the free ends of the first and second cord segments 28 and 30 together to form a single continuous cord between the base and the handset that is longer than either cord segment and sufficiently long for realistic play use of the toy telephone. However, the connecting means is such that upon application of a force in excess of that normally encountered in play use of the toy telephone, the cord separates into its two component segments.

In this preferred embodiment, the connecting means comprises a stud and socket connector 32. The free end of one of the cord segments, for example the first cord segment 28, is provided with a stud 34. A raised annular collar 36 surrounds the stud 34 at its base. The stud preferably has a generally circular cross section. A plurality of longitudinal splines 38 project radially from the stud 34, forming raised lands 40 on the surface of the stud. The free end of the other of the cord segments, =, the second cord segment 30, is provided with a socket 42, adapted to receive the stud 34. The socket 42 preferably has a generally circular cross-section, and is sized so that the lands 40 on the stud 34 frictionally engage the interior walls of the socket to releasably connect the ends of the segments. The circular cross sections of the stud 34 and the socket 42 in the preferred embodiment facilitate the connection of the segments, allowing the cord segments to be connected without careful alignment and making it easier for children to connect.

As best shown in FIG. 3, the stud 34 fits entirely within the socket 42, with the rim of the socket abutting the annular collar 36 to give the cord a smooth, continuous appearance. The frictional grip between the stud 34 and the socket 42 is sufficient to resist separation under the forces normally encountered in the play use of the toy telephone, but weak enough to allow the segments to separate upon the application of forces in excess of those encountered in the normal play use of the telephone. The frictional grip between the stud 34 and the socket 42 is preferably sufficiently strong to resist a disconnection force equal to the weight of the telephone base 22, and preferably weak enough to separate upon the application of about four pounds of force axially along the cord. It has been experimentally determined that four pounds is a satisfactory release tension for the cord.

Thus, the cord 26 of the present invention appears to be a single continuous cord extending between the base and the handset, having an apparent length that is longer than the length of either cord segment and sufficiently long for normal play use of the toy telephone. However, upon application of a force in excess of that normally encountered in play use, the cord 26 readily separates into its component segments 28 and 30. There are presently voluntary regulations in the industry regarding the maximum length for toy telephone cords. Each of the cord segments 28 and 30 may made a preselected length less than this maximum, but each may be sufficiently long that the total length of the cord 26 when the segments are connected is greater than the maximum, thereby providing a toy telephone that is more realistic and consequently more fun to play with than a toy telephone with a shorter cord. For any given cord length, the toy telephone of the present invention provides a phone in which, because of the ready separation of the segments, the effective length of the cord is shorter.

OPERATION

In operation, the toy telephone 20 of the present invention is assembled by inserting stud 34 into socket 42. The toy telephone 20 can then be used like any other toy telephone. The cord has an apparent length equal to the sum of the lengths of the cord segments. The cord 26 is sufficiently long to allow the toy telephone to be held and used by the user like a real telephone. The stud and socket fastener 32 resists separation of the cord in the forces encountered in the normal play use of the telephone.

However, if forces in excess of those normally encountered in the play use of the telephone are applied to the cord, for example if the cord gets tangled on a part of the user's body, the stud and socket connector 32 allows the cord 26 to separate into its two, relatively shorter, components segments 28 and 30. These segments are easier to untangle from the user; and because the are shorter they are less likely to tangle with the user or cause other harms associated with longer cords. Also, there is less chance for damage to the toy telephone, because the cord should separate before it is pulled from the base or the handset.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A toy telephone comprising:

a telephone base;

a telephone handset; and a cord extending between the base and the handset, the cord comprising first and second cord segments of preselected lengths, the first cord segment connected at one end to the base and the second cord segment connected at one end to the handset, and means for releasably connecting the other free ends of the first and second cord segments together to form a single continuous cord between the base and the handset that has an apparent length that is longer than the length of either cord segment and sufficiently long for play use, which cord, upon application of a force in excess of that normally encountered in play use, separates into the segments of pre-selected lengths.

2. The toy telephone according to claim 1 wherein the means for releasably connecting the free ends of the cord segments comprises a frictional connector.

3. The toy telephone according to claim 2 wherein the frictional connector comprises a stud and socket connector.

4. The toy telephone according to claim 3 wherein the stud and socket connector comprises a stud on the free end of one of the cord segments and a socket on the free end of the other of the cord segments adapted to receive the stud.

5. The toy telephone according to claim 4 wherein the stud includes longitudinal splines projecting radially outwardly from the body of the stud for engaging the interior of the socket.

6. The toy telephone according to claim 4 wherein the stud and the socket have generally circular cross sections.

7. The toy telephone according to claim 1 wherein the means for releasably connecting the cord segments is sufficient to resist a disconnection force equal to the weight of the telephone base.

8. The toy telephone according to claim 7 wherein the means for releasably connecting the cord segments releases upon the application of about four pounds of tension on the cord.

9. A toy telephone comprising:

a telephone base;

a telephone handset; and a cord extending between the base and the handset, the cord comprising first and second cord segments of preselected lengths, the first cord segment connected at one end to the base and the second cord segment connected at one end to the handset, and mating connectors at the other free ends of the first and second cord segments for joining the free ends of the first and second cord segments together to form a single continuous cord between the base and the handset that has an apparent length that is longer than the length of either cord segment and sufficiently long for play use, the connectors resisting separation of the segments under the forces normally encountered in the play use of the toy telephone, but readily separating upon the application of a force in excess of that normally encountered in play use.

10. The toy telephone according to claim 9 wherein the connectors at the free ends of the first and second cord segments frictionally engage each other.

11. The toy telephone according to claim 10 wherein one connector comprises a stud and the other connector comprises a socket.

12. The toy telephone according to claim 11 wherein the stud includes longitudinal splines projecting radially outwardly from the body of the stud for engaging the interior of the socket.

13. The toy telephone according to claim 11 wherein the stud and the socket have generally circular cross sections.

14. The toy telephone according to claim 9 wherein the means for releasably connecting the cord segments is sufficient to resist a disconnection force equal to the weight of the telephone base.

15. The toy telephone according to claim 14 wherein the means for releasably connecting the cord segments releases upon the application of about four pounds of tension on the cord.

16. In a toy telephone of the type comprising a telephone base, a telephone handset, and a telephone cord extending between the base and the handset, the improvement comprising:

a cord extending continuously between the base and the handset having an apparent length sufficient to permit realistic play use of the telephone, which if it becomes entangled with the user readily separates into two segments each of substantially shorter length than the continuous cord to facilitate disentanglement, each segment remaining securely attached to one of the base or handset and leaving a free end.

17. The improved toy telephone according to claim 16 wherein the cord comprises mating frictional connectors on the free ends of the cord segments for releasably joining the segments together.

18. The improved toy telephone according to claim 17 wherein mating frictional connectors comprise a stud on the free end of one of the cord segments and a socket on the free end of the other of the cord segments adapted to receive the stud.

19. The improved toy telephone according to claim 18 wherein the stud includes longitudinal splines projecting radially outwardly from the body of the stud for engaging the interior of the socket.

20. The improved toy telephone according to claim 19 wherein the stud and the socket have generally circular cross sections.

21. In a toy telephone of the type comprising a telephone base, a telephone handset, and a telephone cord extending between the base and the handset, the improvement comprising: the cord comprising two segments releasably joined together to form continuous cord extending between the base and the handset having an apparent length sufficient to permit realistic play use of the telephone, which cord, upon the application of force in excess of the amount normally encountered in the play use of the toy telephone, separates into two segments each of substantially shorter length than the assembled cord, each segment remaining securely attached to one of the base or handset.

* * * * *